US005181652A

United States Patent [19]

Tanttu et al.

[11] Patent Number: 5,181,652

[45] Date of Patent: Jan. 26, 1993

[54] PACKAGING

[75] Inventors: Pekka Tanttu, Espoo; Osmo E. O. Valkeinen, Vantaa, both of Finland

[73] Assignee: Elopak Systems AG, Glattbrugg, Switzerland

[21] Appl. No.: 729,562

[22] Filed: Jul. 15, 1991

Related U.S. Application Data

[60] Division of Ser. No. 600,015, Oct. 18, 1990, Pat. No. 5,059,082, which is a continuation of Ser. No. 305,749, Feb. 2, 1989, abandoned.

[30] Foreign Application Priority Data

Feb. 2, 1988 [FI] Finland ..... 880476

[51] Int. Cl.[5] ..... B65D 5/42

[52] U.S. Cl. ..... 229/243; 206/815; 229/126; 229/162; 229/900; 229/DIG. 8

[58] Field of Search ..... 229/40, 126, 162, 204, 229/243, 244, 900, DIG. 8; 206/815

[56] References Cited

U.S. PATENT DOCUMENTS

| | | | |
|---|---|---|---|
| 1,472,661 | 10/1923 | Mengel | 229/900 |
| 1,751,170 | 3/1930 | Parker | 229/900 |
| 2,075,259 | 3/1937 | Battjes | 229/DIG. 8 |
| 2,319,909 | 5/1943 | Young | 229/900 |
| 2,326,683 | 8/1943 | Ross | 229/DIG. 8 |
| 2,618,887 | 11/1952 | Frankenstein | 229/DIG. 8 |
| 2,719,664 | 10/1955 | Hester | 229/900 |
| 2,724,539 | 11/1955 | Schenk | 229/DIG. 8 |
| 2,772,827 | 12/1956 | Rafoth et al. | 229/DIG. 8 |
| 3,197,110 | 7/1965 | Neuman et al. | 229/244 |
| 3,580,476 | 5/1971 | Cannon et al. | 229/900 |

*Primary Examiner*—Gary E. Elkins

*Attorney, Agent, or Firm*—Reising, Ethington, Barnard, Perry & Milton

[57] ABSTRACT

In a method of emptying from a case a compressible load consisting of carton blanks, prongs penetrate through preformed perforations in opposite side walls of the case and push the load away from those walls, an upper portion of the case is partially severed by knives along respective paths at those walls, other cuts are formed across the top wall along the other two side walls of the case, suction cups pull away that upper portion, the load is received between support fingers, the load and the lower portion of the case are turned through 180 degrees in a vertical plane, the inverted lower portion is removed from the load by suction cups, and a gripping head seizes the load and removes it from between the support fingers.

10 Claims, 4 Drawing Sheets

PACKAGING

This is a division of application Ser. No. 600,015, filed on Oct. 18, 1990, now U.S. Pat. No. 5,059,082 which is a continuation of Ser. No. 07/305,749 filed Feb. 2, 1989, abandoned.

BACKGROUND OF THE INVENTION

1. Field of the Invention

This invention relates to a method of emptying from a container a compressible load consisting of a plurality of items, apparatus for performing the method, a container to be emptied, and a container blank.

2. Description of the Prior Art

British Patent 1017036 discloses a method and apparatus for the removable of wrappers from bottles and the like. A parallelepipedic container contains rows of bottles with flanged necks. The material of the container may be paper, corrugated pasteboard, cardboard, light-metal foil, plastics, cloth, or other suitable material. The container with the bottles therein is advanced along a horizontal path at respective opposite sides of which are arranged two horizontal knives which cut through the container wall to form two cuts at those opposite sides, at a level a short distance below a top wall of the container. The container is then advanced along a second horizontal path at right angles to its first horizontal path and a horizontal knife at one side of the second path and at that same level cuts through the adjacent side wall of the container, so that the upper portion of the container is now free from the remainder of the container on three sides, and a vertical knife extending centrally of the path cuts through the leading side wall and the lagging side wall of the container, whilst a plurality of pointed bars extending longitudinally of the second path receive the flanged necks of the bottles among them and the container is pushed downward from the bottles by a plate inserted vertically downward between two rows of the bottles.

The method and apparatus of that British patent are designed specifically for use with bottles having flanged necks and are not generally suitable for a compressible load. For example, the knives used would very likely damage any compressible load in contact with walls being cut by the knives.

European Patent Application Publication 0059982 discloses a method and apparatus for removing a paperboard container from a pile of continuous stationery contained therein. The container comprises a cover, a bottom wall and at least three side walls which can be folded flat after removal of the cover. With the container at a processing station, a pair of jaws grasps the cover and carries it away, thus allowing the side walls to lie flat. A jack displaces an arm to push the pile of continuous stationery off the bottom wall onto a conveyor which carries the pile away. Suction cups on the ends of the jaws and connected to vacuum lines then grasp and carry away the unit consisting of the bottom and side walls. This method and apparatus are suitable for a cohesive load but not for a load consisting of a plurality of items, since these would very likely become disorientated or scattered.

Federal German Patent Application Publication 2546594 discloses a method and apparatus for packing folded cartons into a transport container. The folded cartons are accumulated into a horizontal row between end plates. Then a horizontal, handled yoke having further end plates resiliently urged inwards, but pressed outwards by the operative applying his thumb to a spring-load push-button, is manually applied over the top of the row. The operative releases the push-button to clamp the row between the end plates of the yoke, then carries the yoke, with the folded cartons gripped between its end plates, to the container, and presses the push-button to move the end plates resiliently outwardly to drop the folded cartons in the container.

In an existing method and apparatus for emptying a compressible load consisting of individual carton blanks out of a fibreboard case, the top wall of which is partially perforated along its edges, the top wall of the case is cut along its edges and, thereafter, the case together with its load, is turned upside down onto a horizontal supporting surface. FIG. 1 of the accompanying drawings is a top perspective view which illustrates the next step in the method. Suction cups 3 are lowered to and seize the inverted bottom wall 1*c* of the previously lower portion of the case 1. The suction cups are then raised to raise that lower portion, with the intention that the cartons blanks 2 should remain resting upon the horizontal support surface 13 in two rows 2*a* and 2*b*. Before the lower portion is completely removed from its load 2, grippers 4 are pressed against the ends of the rows 2*a* and 2*b*. One pair of grippers 4 is shown. Another pair will be disposed at the opposite ends of the rows, so that the rows are compressed between their respective pairs of grippers. Once the lower portion has been lifted off completely, the load of blanks 2 is transferred to its point of use.

A difficulty with this existing method and apparatus is that often the carton blanks catch on the edges or sides of the lower portion of the case and hence do not fall from the case ready to be gripped by the grippers 4.

SUMMARY OF THE INVENTION

According to one aspect of the present invention, there is provided a method of emptying from a closed container a compressible load comprised of a plurality of individual items, including causing pushing means to penetrate wall means of said container and to push said load away from a wall of said wall means, cutting through said wall to form a cut therethrough while said load is held away from said wall by said pushing means, and producing relative displacement between said container and a portion of said wall means bounded by said cut to open said container.

According to another aspect of the present invention, there is provided apparatus for emptying from a closed container a compressible load comprised of a plurality of items, including pushing means, drive means serving to produce relative movement between said pushing means and said container to cause said pushing means to penetrate wall means of said container and to push said load away from a wall of said wall means, cutting means serving to cut through said wall to form a cut therethrough, and displacing means serving to produce relative displacement between said container and a portion of said wall means bounded by said cut to open said container.

An advantage of this arrangement is that once the load has been pushed away from the wall means, the necessary cutting action can readily be taken to open the container, without the load also being cut into.

According to a third aspect of the present invention, there is provided a container for a compressible load comprised of a plurality of individual items, comprising wall means and preformed perforation means in said wall means and whereby pushing means may penetrate said wall means.

According to fourth aspect of the present invention, there is provided a blank for forming a container for a compressible load comprised of a plurality of individual items, said blank comprising panel means and preformed perforation means in said panel means and whereby pushing means may penetrate said panel means.

A particular advantage of this container and container blank is that blunt pushing means can be used to penetrate the container walls, so reducing any risk of damage to the load by the pushing means.

BRIEF DESCRIPTION OF THE DRAWINGS

In order that the invention may be clearly understood and readily carried into effect, reference will now be made, by way of example, to FIGS. 2 to 12 of the accompanying drawings, in which.

DESCRIPTION OF THE PREFERRED EMBODIMENTS

Figures 1, 2:
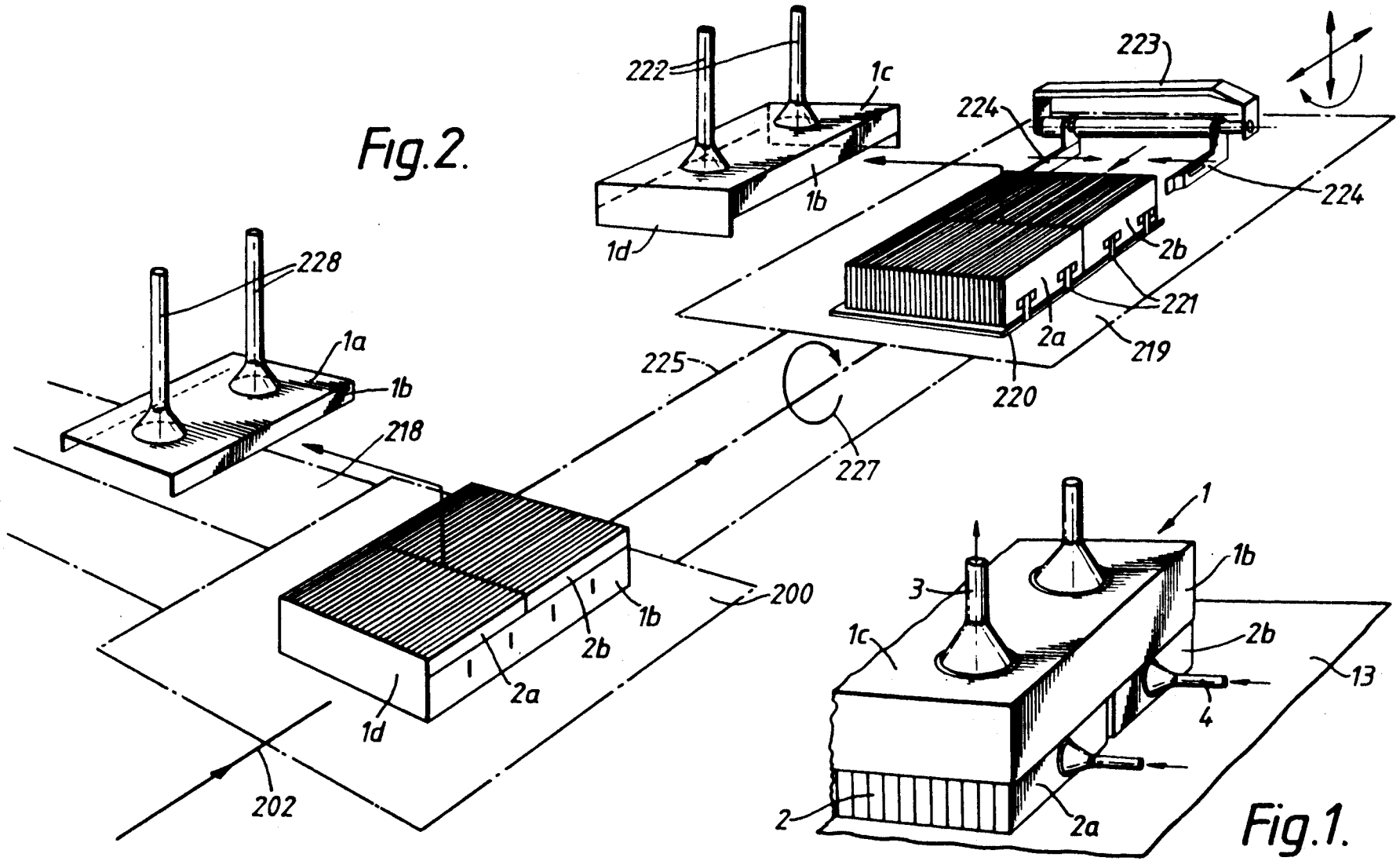
FIG. 1 is a top perspective view which illustrates an existing method.
FIG. 2 illustrates diagrammatically a system for emptying from a fibreboard case a compressible load consisting of individual carton blanks.
Figure 3:
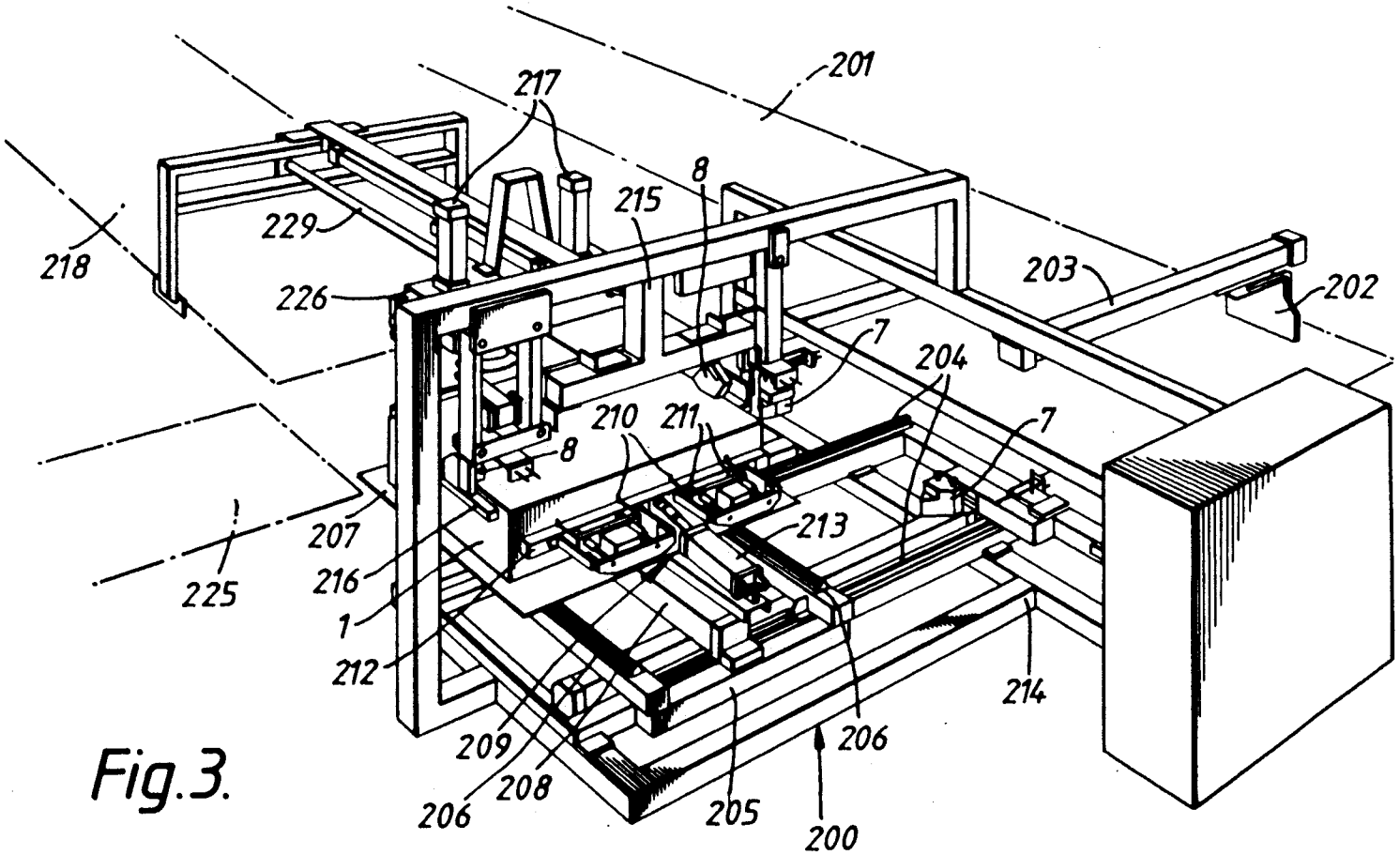
FIG. 3 shows a diagrammatic perspective view of an opening station of the system.
Figure 4:
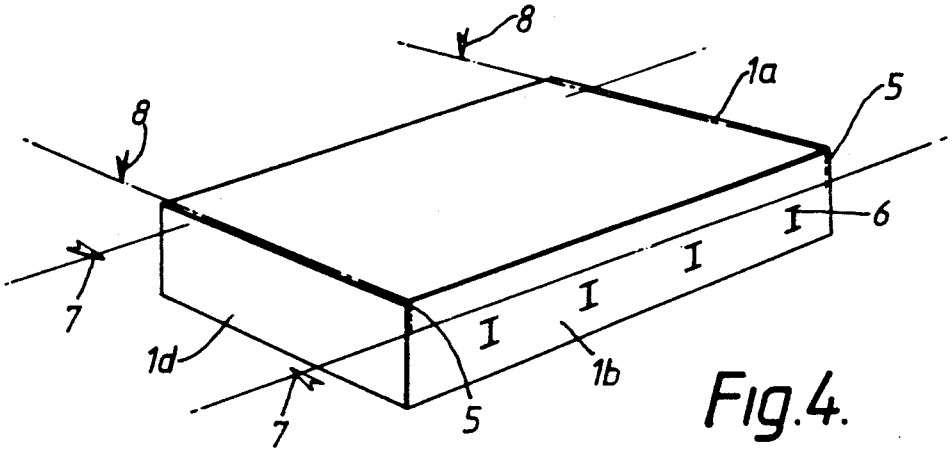
FIG. 4 shows a diagrammatic perspective view of a closed fibreboard case as it arrives at the opening station.
Figure 5:
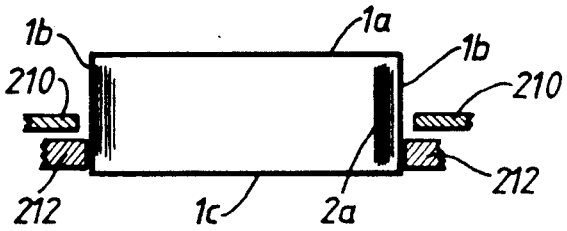
FIG. 5 shows a diagrammatic vertical sectional view through the case at the opening station but again prior to penetration of its walls.
Figure 6:
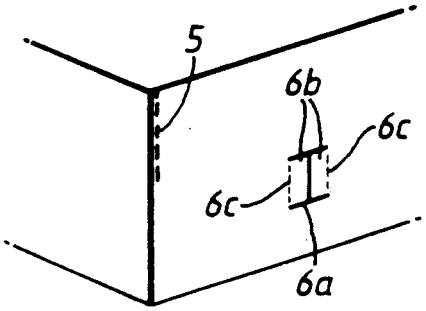
FIG. 6 shows a corner detail of FIG. 4.

Referring to FIGS. 2 to 9, the system includes an opening station 200 to which are fed in turn from a store a plurality of containers 1 (each as shown in FIG. 4), by means of a supply conveyor 201 and a transverse pusher 202 operated by a screw or air cylinder device 203 mounted on a fixed frame 214. Mounted upon a pair of transverse horizontal guide rails 204 is a frame-form carriage 205 including horizontal guide rails 206 which extend parallel to the conveyor 201 and upon which is mounted a platform-like carriage 207 displaceable along the guide rails 206 by a screw or air cylinder device 208 mounted on the carriage 205. At the front and rear of the carriage 205 are respective similar assemblies, of which one is seen in FIG. 3 and referenced 209. The assembly 209 includes four plunger-form prongs 210 operated by respective drive devices, for example air cylinders, 211, and having blunt pushing portions. The prongs 210 and their drive devices 211 are supported by a horizontal transverse bar 212 displaceable parallel to the conveyor 201 by a screw or air cylinder device 213 anchored to the carriage 207. Two horizontal longitudinal bars (of which one is seen and referenced 216) are retractably supported upon a carriage 215 displaceable transversely of the conveyor 201 upon the frame 214. Adjustably fixed to the frame 214 are two horizontal knives 7. Also adjustably fixed to the frame 214 are two horizontal knives 8. After the knives 8, there are a pair of screw or air cylinder devices 217 which lift and lower respective suction cups 228 (see FIG. 2) connected to vacuum lines (not shown). The device 208 serves to advance the carriage 207 towards a conveyor 225 which conveys opened cases 1 towards a carton blanks feeding station 219. In the region of the feeding station 219 is a plate 220 along respective opposite edges of which are arranged respective rows of support fingers (of which one row is hidden in FIG. 2 and of which the other row is seen and referenced 221). At the feeding station 219 is arranged a pair of suction cups 222 and a gripping head 223 having a pair of gripping jaws 224. At the opening station 220 is a conveyor 218 for forwarding case tops to waste or recycling. The devices 217 and the cups 228 are supported upon a carriage 226 displaceable parallel to the conveyor 201 upon a rail arrangement 229.

Each fibreboard case 1 contains two horizontal rows **2*a* and 2*b* of liquid carton blanks packed face-to-face. The case 1 has been made from the blank shown in FIG. 9. The blank consists of a major panel 1*a* which will constitute the top wall 1*a* of the case, a major panel 1*c* which will constitute the bottom wall 1*c* of the case, minor transverse panels 1*b* which will constitute two opposite vertical side walls 1*b* of the case, a number of lateral panels 1*d* which will constitute the other two vertical side walls 1*d* of the case, and a transverse sealing seam panel 1*e* which will be affixed to the free edge zone of the panel 1*a*. Extending from the innermost corners of the panel 1*a* for a short distance towards the panel 1*c* are respective lines 5 of partial perforation formed in the panel 1*b* between the panels 1*a* and 1*c***.

Similar lines 5 of partial perforation extend from the innermost corners of the panel **1*e* towards the panel 1*c* and are formed through the other panel 1*b*. Formed through each panel 1*b* is a row of four preformed perforations 6 so arranged as to constitute a horizontal row across the corresponding side wall 1*b* of the case 1. Each perforation 6 comprises an I-shaped through cut 6*a* to bound a pair of door-like partially-severed portions 6*b* which can turn about hinges constituted by respective score lines 6*c*. Score lines 7' bound the panels 1*a* to 1*e*** to enable them to be folded correctly relative to each other.

Figure 7:
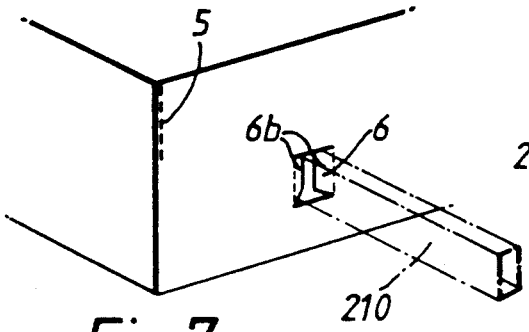
FIG. 7 shows a view similar to FIG. 6, but at the commencement of penetration of the walls.
Figure 8:
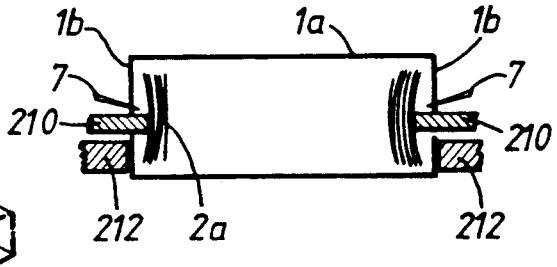
FIG. 8 shows a view similar to FIG. 5, but with the walls more fully penetrated than in FIG. 7.
Figure 9:
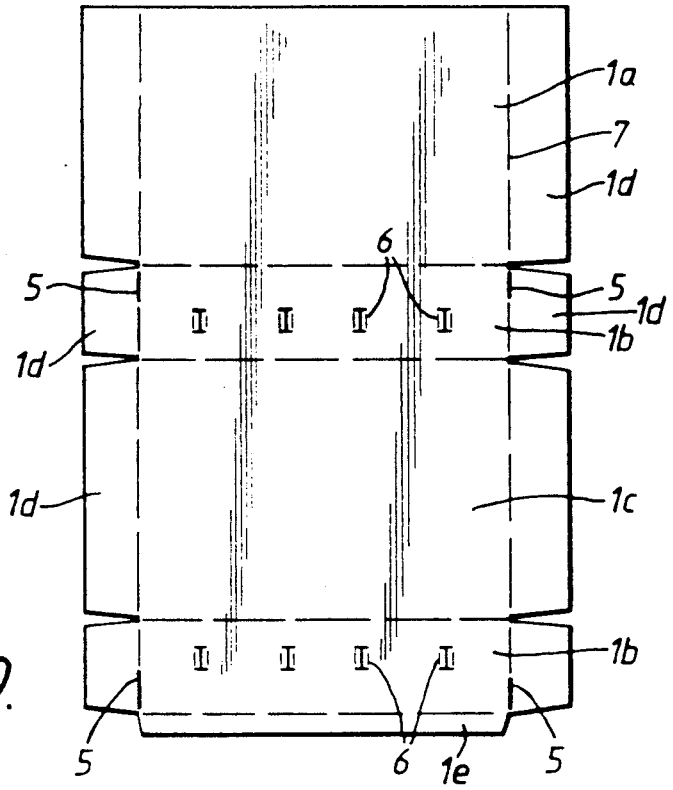
FIG. 9 shows a plan view of a blank from which the container of FIG. 4 has been made.

With the case 1 erected and filled with the blanks 2 and sealed closed, it is stored in the store (not shown) and later such filled cases are fed in turn onto the conveyor 201. With the carriage 205 in its right-hand end position (not shown) in FIG. 3, with the carriage 207 directly beneath the device 203, and with the two assemblies (such as 209) retracted, the pusher 202 displaces one case transversely onto the carriage 207. The bars 212 are then advanced towards the case 1 to bear upon the side walls **1*b* and thus centre the case between them (see FIG. 5). Similarly, the bars such as 216 come to bear upon the other side walls 1*d* of the case 1 to centre the case 1 between them. Then the eight prongs (such as 210), with their blunt pushing portions, penetrate through the respective eight perforations 6, opening the doors 6b inwardly, as illustrated in FIG. 7. The prongs 210 advance into the case a distance enough to push the carton blanks inwardly away from the two side walls 1b sufficiently for the cutting operation of the knives 7 now to be described. The carriage 205 is now displaced from the right-hand end position to the left-hand end position shown in FIG. 3. This carries the case 1 horizontally past and in contact with the knives 7, whereby the knives 7 cut respective horizontal slits through the walls 1b at the level of the lower ends of the perforated lines 5. This operation is illustrated in FIG. 8. Next, the carriage 207 is advanced longitudinally towards the conveyor 218. This causes the case 1 to be carried past the two knives 8 which thus form, through the top wall 1a, respective parallel slits, joining the upper ends of the lines 5. The suction cups 218 are now lowered to and seize the top wall 1a, and are then raised to pull the wall 1a upwards, thus fracturing the perforated lines 5 and allowing the top portion defined by the slits formed by the knives 7 and 8 and the fractured lines 5 to be lifted away and displaced by the carriage 226 to a position above the conveyor 218 onto which the top portion is dropped. Meanwhile, the carriage 207 is advanced into aligment with the conveyor 225, the assemblies (such as 209) and at least the left-hand centering bar 216 in FIG. 3 are retracted, and the open case 1 is now advanced by the conveyor 225 towards a turning station, indicated diagrammatically at 227 in FIG. 2. At this turning station, the open case is received beneath the plate 220. The support fingers 221, which extend downwardly from the plate 220 are caused to bear against the exposed surface parts of the ends of the rows 2a and 2b and clamp the blanks 2 between them. The plates 220, the support fingers 221 and the open case are now turned through 180 degrees in a vertical plane and advanced to the feeding station 219. At this station, the suction cups 222 are lowered to and seize the bottom wall 1c of the case, and are raised to lift off the remainder of the case, which is again taken to a waste or recycling conveyor (not shown). The two rows of carton blanks 2a and 2b held upright by the support fingers 221, can now be seized in turn between the jaws 224 of the gripping head 223** and carried away for use.

Figure 10:
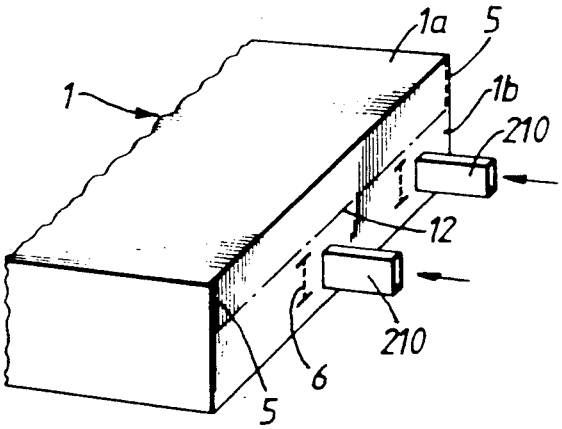
FIG. 10 shows a diagrammatic perspective view of a modification of the system, with a modified container being illustrated prior to penetration of its walls.
Figure 11:
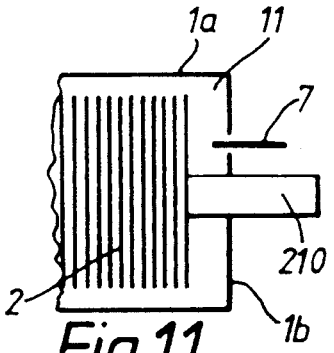
FIG. 11 shows diagrammatically a vertical section through the modified container following penetration of its walls.
Figure 12:
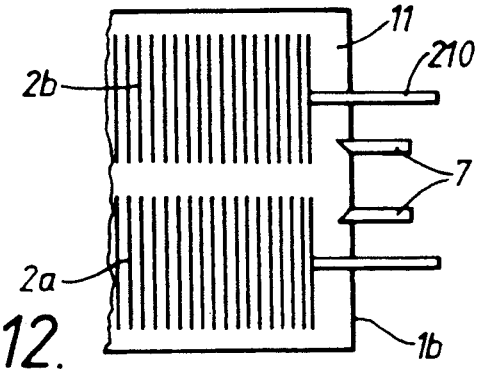
FIG. 12 shows a diagrammatic horizontal section through the container of FIG. 11.

The version shown in FIGS. 10 to 12 differs from that described with reference to FIGS. 2 to 9 chiefly in that the prongs 210, producing the space 11 between each side wall 1b and the carton blanks 2 are only two in number at each side wall 1b, and in that two knives 7 are used to produce the slit (the path of which is indicated at 12 in FIG. 10) at each side wall 1b, the two knives 7 at each side wall 1b moving from the ends of the wall to the centre of the wall to form the slit.

By employing preformed perforations 5 and 6 which are relatively short and substantially vertical, the load-bearing capacity of the case is substantially unaffected. Thus, for example, perforation along the length of the line 12, which would significantly weaken the case, is avoided. It will be appreciated that the number and size of the prongs 210 and of the perforations 6 depends upon the character of the load.

Depending upon the manner of packing of the load, the pushing away from the wall and the cutting are carried out at one or more walls of the case.

We claim:

1. A container for a compressible load comprised of a plurality of items, comprising a top wall, a bottom wall, four substantially vertical side walls distributed about said top wall and said bottom wall, preformed perforation means formed in two opposite side walls of the four side walls and whereby pushing means may penetrate said two opposite side walls to compress said load away from said two opposite side walls, and partially perforated linear wall portions which are substantially vertical and located in regions of upper corners of said two opposite side walls.

2. A blank for forming a container for a compressible load comprised of a plurality of items, said blank comprising, progressing away from one transverse edge of said blank towards an opposite transverse edge of said blank, a first major panel, a first minor panel, a second major panel and a second minor panel, and, at opposite longitudinal edge regions of said blank, lateral panels, and preformed perforation means formed in the first and second minor panels and whereby pushing means may penetrate said first and second minor panels to compress said load away from said first and second minor panels in said container, said preformed perforation means comprising a plurality of perforations each comprising an I-shaped perforation to bound a pair of partially severed, inwardly turnable portions of said first minor panel and said second minor panel.

3. A blank according to claim 2, wherein said partially severed portions are turnable about hinges constituted by respective score lines.

4. A blank for forming a container for a compressible load comprised of a plurality of items, said blank comprising, progressing away from one transverse edge of said blank towards an opposite transverse edge of said blank, a first major panel, a first minor panel, a second major panel and a second minor panel, and, at opposite longitudinal edge regions of said blank, lateral panels, preformed perforation means formed in the first and second minor panels and whereby pushing means may penetrate said first and second minor panels to compress said load away from said first and second minor panels in said container, and partially perforated linear panel portions extending along said blank and being located in regions of edge portions of said first minor panel and said second minor panel extending along said blank.

5. A container containing a compressible load comprised of a plurality of blanks which are to be formed into respective cartons, said container comprising a top wall, a bottom wall, four substantially vertical side walls distributed about said top wall and said bottom wall, and preformed perforation means formed in one of two opposite side walls of the four side walls and whereby pushing means may penetrate said one of said two opposite side walls to compress said load away from said one of said two opposite side walls.

6. A container according to claim 5, wherein such preformed perforation means are formed in both of said two opposite side walls.

7. A container according to claim 5, wherein said preformed perforation means comprise partially severed, inwardly turnable portions of said one of said two opposite side walls.

8. A container according to claim 7, wherein said preformed perforation means comprise a plurality of perforations each comprising an I-shaped perforation to bound a pair of partially severed inwardly turnable portions.

9. A container according to claim 8, wherein said partially severed portions are turnable about hinges constituted by respective score lines.

10. A container according to claim 8, wherein there is a plurality of said perforations distributed along said one of said two opposite side walls.

* * * * *